US008455744B2

(12) United States Patent
Barnett

(10) Patent No.: US 8,455,744 B2
(45) Date of Patent: Jun. 4, 2013

(54) ADJUSTABLE MAGNETIC GUITAR OR SIMILAR STRINGED INSTRUMENT SUPPORT

(75) Inventor: Kristopher C. Barnett, Atlanta, GA (US)

(73) Assignee: Kristopher Barnett, Atlanta, GA (US)

( * ) Notice: Subject to any disclaimer, the term of this patent is extended or adjusted under 35 U.S.C. 154(b) by 0 days.

(21) Appl. No.: 13/276,317

(22) Filed: Oct. 18, 2011

(65) Prior Publication Data

US 2013/0092009 A1 Apr. 18, 2013

(51) Int. Cl.
*G10D 3/00* (2006.01)

(52) U.S. Cl.
USPC ..... 84/327; 224/910

(58) Field of Classification Search
USPC ..... 84/327; 224/910
See application file for complete search history.

(56) References Cited

U.S. PATENT DOCUMENTS

| | | | | | |
|---|---|---|---|---|---|
| 752,664 | A * | 2/1904 | Foley | 84/327 |
| 1,261,841 | A * | 4/1918 | Mortensen | 84/327 |
| 1,272,583 | A * | 7/1918 | Vrubel | 84/327 |
| 1,285,802 | A * | 11/1918 | Russell | 84/327 |
| 1,802,236 | A * | 4/1931 | Carroll et al. | 84/327 |
| 1,945,162 | A * | 1/1934 | Rasmussen | 84/327 |
| 4,592,265 | A * | 6/1986 | Steinberger | 84/327 |
| 4,966,062 | A * | 10/1990 | Driggers et al. | 84/327 |
| 5,388,492 | A * | 2/1995 | Olson | 84/327 |
| 5,616,874 | A * | 4/1997 | Kraus et al. | 84/327 |
| D410,669 | S * | 6/1999 | Hamre | D17/20 |
| 6,252,150 | B1 * | 6/2001 | Johnson | 84/327 |
| 6,576,823 | B1 * | 6/2003 | Wise, Jr. | 84/327 |
| 7,732,689 | B1 * | 6/2010 | Jiang et al. | 84/327 |
| 8,203,061 | B2 * | 6/2012 | Markakis | 84/327 |
| 2008/0196572 | A1 * | 8/2008 | Navarro | 84/327 |
| 2012/0312144 | A1 * | 12/2012 | Bibb | 84/327 |

* cited by examiner

*Primary Examiner* — David Warren
*Assistant Examiner* — Robert W Horn

(57) ABSTRACT

An improved adjustable stringed instrument apparatus, hereafter known as 'support', 'instrument support' or 'guitar support', that supports the instrument in playing position while the user is in the sitting position. The support attaches to the instrument using magnets and rests on the user's leg. It utilizes a flexible leg support means connected to a magnetic attachment means, also referred to as the magnet housing, at one end and an adjustable rigid support with hinged pivoting magnet housing on the opposing end. Three discrete mechanisms on the support allow for vertical, horizontal, and angular adjustments of the instrument. The support's design allows it to be easily attached, removed, collapsed, and stored with no detrimental effects to the instrument. It also allows the support to be securely attached to a variety of imperfect surfaces.

3 Claims, 9 Drawing Sheets

ADJUSTABLE MAGNETIC GUITAR OR SIMILAR STRINGED INSTRUMENT SUPPORT

PRIOR ART AND BRIEF SUMMARY OF THE INVENTION

There have been several designs for an apparatus that supports a guitar or similar stringed instrument while in the seated playing position (U.S. Pat. Nos. 7,732,689; 7,205,468; 6,252,150; 6,005,175; 4,966,062 and 3,979,993). The current invention implements novel and improved mechanisms for both adjustment of the instruments position vis-à-vis the player while attached to the support and the means for attachment of the support to the instrument.

An object of this invention is to provide a novel instrument support that can be securely attached to any acoustic guitar or like instrument regardless of the instruments finished surface. Previous designs implemented plastic or rubber suction cups, or similar attachment means, that do not adhere well to worn, damaged, porous, delicate, oily, or otherwise imperfect surfaces (U.S. Pat. Nos. 7,205,468; 6,252,150; 6,005,175; 4,966,062). It is also well established that these attachment means can be deleterious to various finishes such as nitrocellulose lacquer and shellac, finishes commonly found on stringed instruments. Furthermore, such contacting means require periodic replacement as their usefulness as an attachment means decreases in time due to wear and/or material breakdown.

Other designs use an apparatus that supports the instrument from underneath but is not directly or securely attached to it (U.S. Pat. Nos. 7,732,689 and 3,979,993). The Support cushion (U.S. Pat. No. 3,979,993) is limited in both its adjustability and ease of storage, while the Foldable support (U.S. Pat. No. 7,732,689) only allows for vertical adjustment and not horizontal or angular adjustments. Further disadvantages of existing designs have been noted by Jiang & Yan (U.S. Pat. No. 7,732,689).

The current support alleviates the above mentioned issues by implementing magnets as the attachment means to the instrument and three discrete mechanisms for vertical, horizontal, and angular adjustments. Magnets or magnetic material attached to the support means attract magnets or magnetic material installed on or in the body of the instrument. Magnetic attraction, or similar fields of force, is the mechanism by which the instrument support attaches to the instrument.

Three discrete mechanisms allow for vertical, horizontal, and angular adjustments. Vertical adjustments are achieved by adjusting the length of the flexible leg support means. The pivoting magnet housing allows horizontal adjustments while in playing position. These adjustments are made by moving the support longitudinally along the underside of the instrument. This adjustment is possible because the rotating magnet housing will conform to any contour on the underside of the instrument. The adjustable rigid support means allows angular adjustment of the instrument while in playing position. These adjustments are achieved by loosening the securing member and adjusting the overall length of the support.

These objects are achieved by a novel support that comprises a flexible leg support means connected to both an adjustable rigid support means with hinged pivoting magnet housing at one end and a second magnet housing at the other. The instrument support is held in place on the instrument by magnetic attraction or similar fields of a force.

DETAILED DESCRIPTION OF DRAWINGS

It has been illustrated that an instrument support that can be attached to the instrument using magnets or magnetic material and is adjustable by three discrete mechanisms may be provided in accordance with this invention. These figures represent one possible embodiment of the invention and are not meant as an exhaustive representation of all possible designs.

Figure 1:
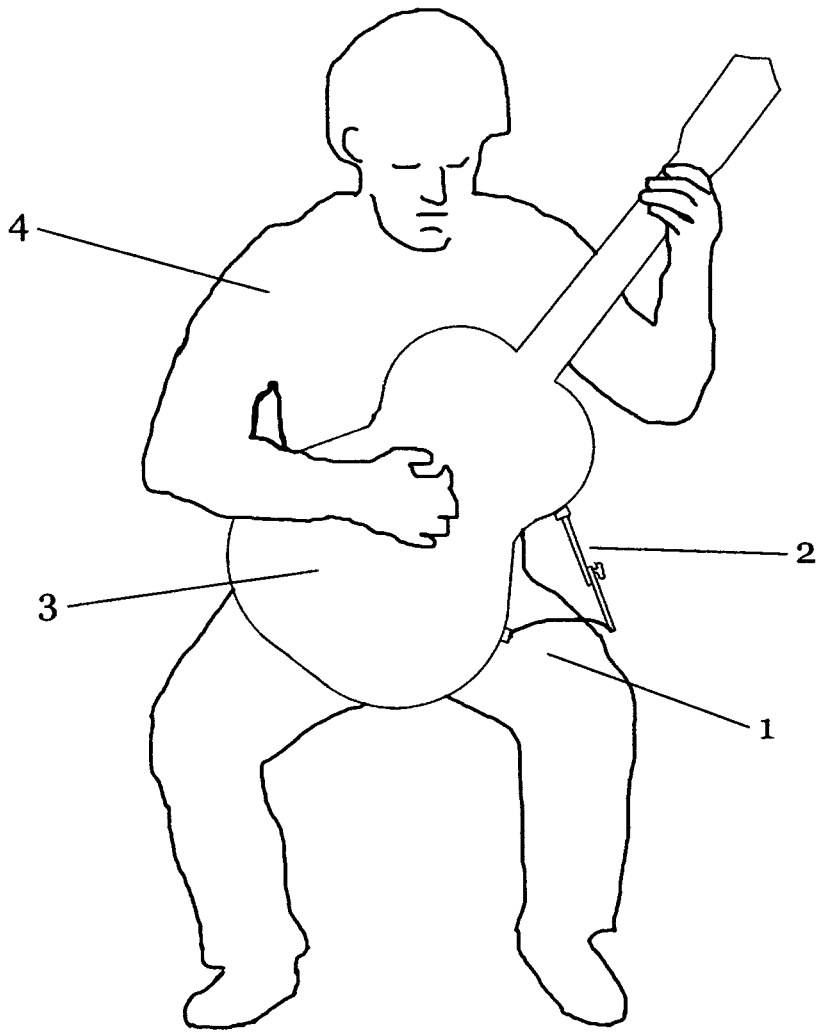
FIG. 1 of the drawings is a perspective view of an instrumentalist using the instrument support in accordance with this invention.

FIG. 1 of the drawings illustrates an instrumentalist (4) in sitting position playing an instrument (3) with the instrument support (2) in accordance with this invention. The support (2) is attached to the instrument (3) and rests on the player's leg (1). The support (2) will be described in further detail with reference to FIG. 2.

Figure 2:
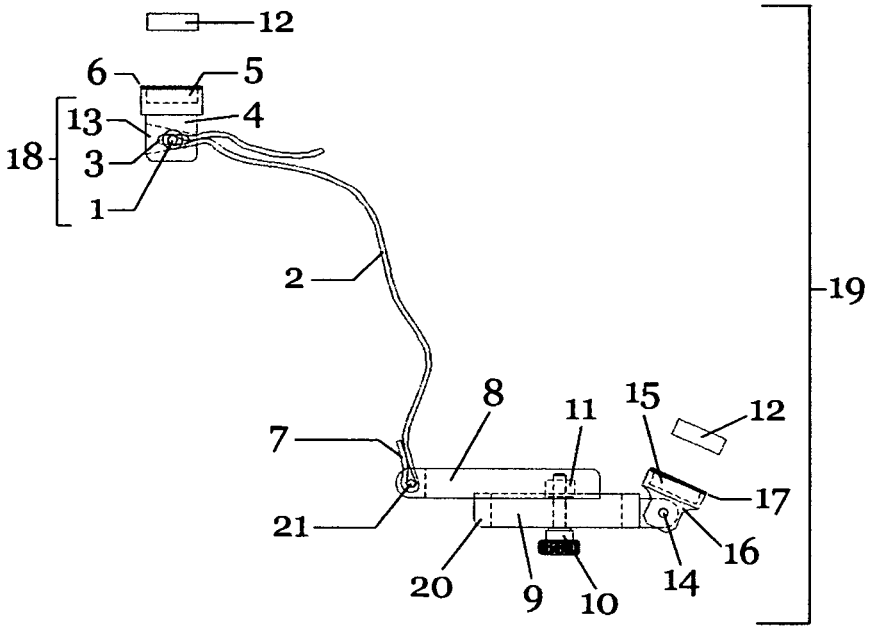
FIG. 2 of the drawings is a perspective detailed view of the instrument support in accordance with this invention.

FIG. 2 of the drawings is a lateral, semi-transparent view of the support. The support (19) is comprised of a flexible, slip-resistant leg support means (2) attached to a first magnet housing (4) on one end and a first rigid support member (8) on the opposing end. The flexibility of the leg support means (2) allows the support to be easily collapsed and stored and also allows maximum comfort for the user. The housing (4) comprises a soft, non-corrosive, and slip-resistant material (6) that separates the housing (4) from the instrument. The material (6) is a protective barrier between the instrument and the housing (4) and also ensures continuous proper placement of the support (19) while attached to the instrument. The housing (4) also contains a magnet(s) or magnetic material (5) that attract other magnet(s) or magnetic material (12) that are installed in or on the side of the instrument. The housing (4) is also comprised of an adjustment mechanism (18) that allows the length of the leg support means (2) to be adjusted. Adjusting the length of the leg support means (2) alters the vertical positioning of the instrument while attached to the support (19). The adjustment mechanism (18) is comprised of a machined void (13), a channel (3), and a securing pin or similar member (1) that is free to move along the length of the channel (3) when the mechanism is not in a secured state. The leg support means (2) is inserted between the securing pin (1) and magnet housing (4). The leg support means (2) then envelopes the securing pin (1), and exits the housing (4). The adjustment mechanism (18) secures the leg support means (2) when force is applied to the securing pin (1), thereby moving it along the channel (3) toward the majority portion of the instrument support (19) until the leg support means (2) is fixed between the securing pin (1) and the magnet housing (4). The leg support means (2) is unsecured using force to move the securing pin (1) along the channel (3) away from the majority portion of the support (19). The leg support means (2) passes through a slot or similar component (21) in the first rigid support means (8) and is affixed back on to itself (7). It is obvious that many options for securing the leg support means (2) to the first rigid support (8) exists. A second rigid support means (20) is machined to form a channel (9) allowing the overall total length of the first rigid support (8) and second rigid support (20) to be increased or decreased. Adjusting the overall length of the first rigid support (8) and second rigid support (20) will alter the angle of the instrument in relation to an assumed horizontal plane. The overall length of the first rigid support (8) and second rigid support (20) is secured with a threaded male member (10) that is inserted into a threaded female member (11) in the first rigid support (8). It is obvious that these members can be reversed so that a threaded male member is attached to the first rigid support (8) and is accepted by a female member on the second rigid support (20). A hinge or similar mechanism (14) connects the second magnet housing (16) to the second rigid support member (20). The second magnet housing (16) comprises a soft, non-corrosive, and slip-resistant material (17) that separates the housing (16) from the instrument. The material (17) is a protective barrier between the instrument and the housing (18) and also ensures continuous proper placement of the support (19) while attached to the instrument. The housing (16) also contains a magnet(s) or magnetic material (15) that attract other magnet(s) or magnetic material (12) that are installed in or on the side of the instrument. The hinge (14) allows the second magnet housing (16) to adopt any curve on the side of the instrument thus allowing unlimited horizontal positioning of the support on the instrument.

Figure 3:
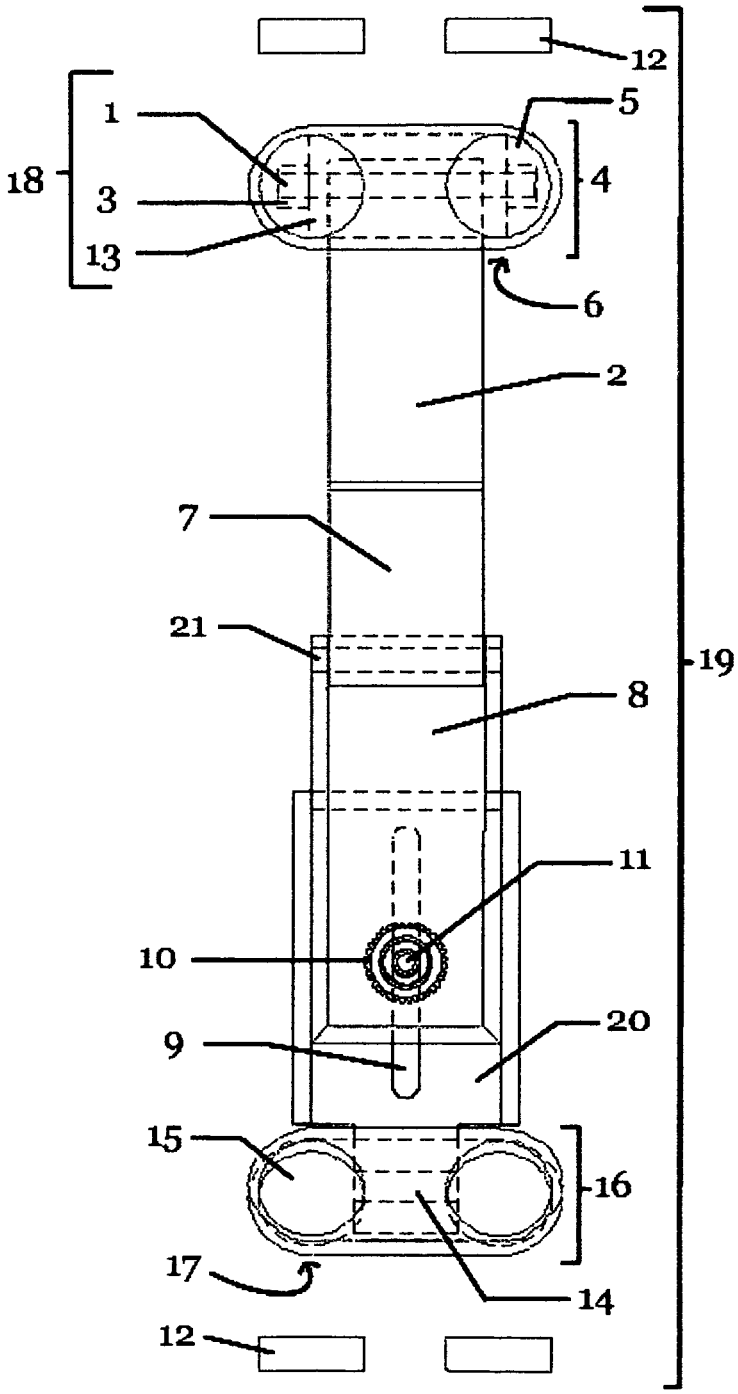
FIG. 3 of the drawings is a perspective view of the instrument support from above as it lays flat.

FIG. 3 of the drawings is a semi-transparent illustration of the instrument support means viewed from above as it lays flat. All components, members, mechanisms, and features visible in FIG. 2 (1-20) are duly illustrated in this view. The first magnet housing (4) is attached to the leg support means (2), which is attached to the first rigid support means (8), which is attached to the second rigid support means (20), which is hinged to the second magnet housing (16). The machined channel (9) in the second rigid support (20) is clearly visible from this perspective.

Figure 4:
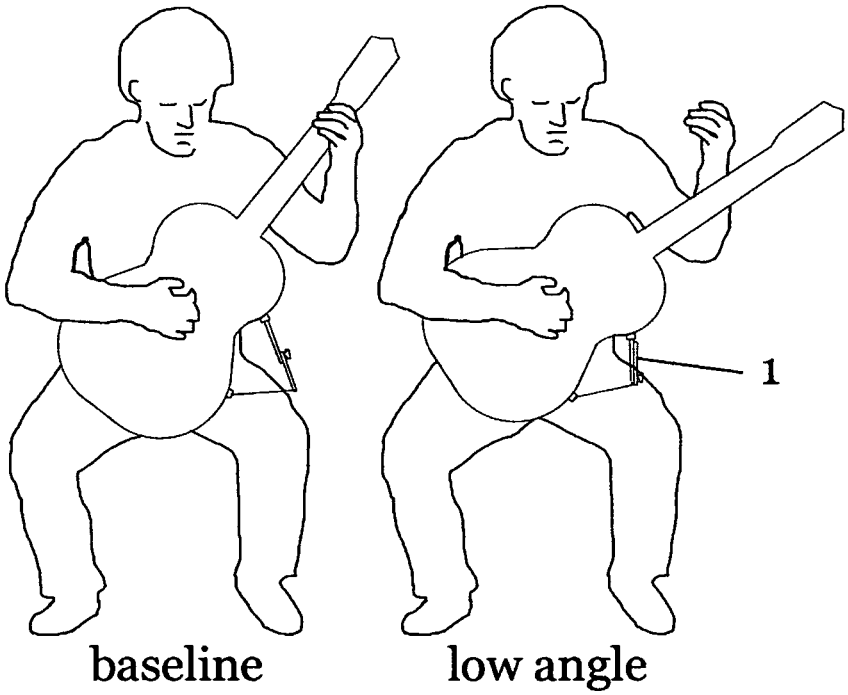
FIG. 4 of the drawings illustrates use of the angular adjustment mechanism of the support.

FIG. 4 of the drawings illustrates use of the angular adjustment mechanism of the support. Adjusting the length of the first and second support means (1) will alter the angular position of the instrument in relation to an assumed horizontal plane.

Figure 5:
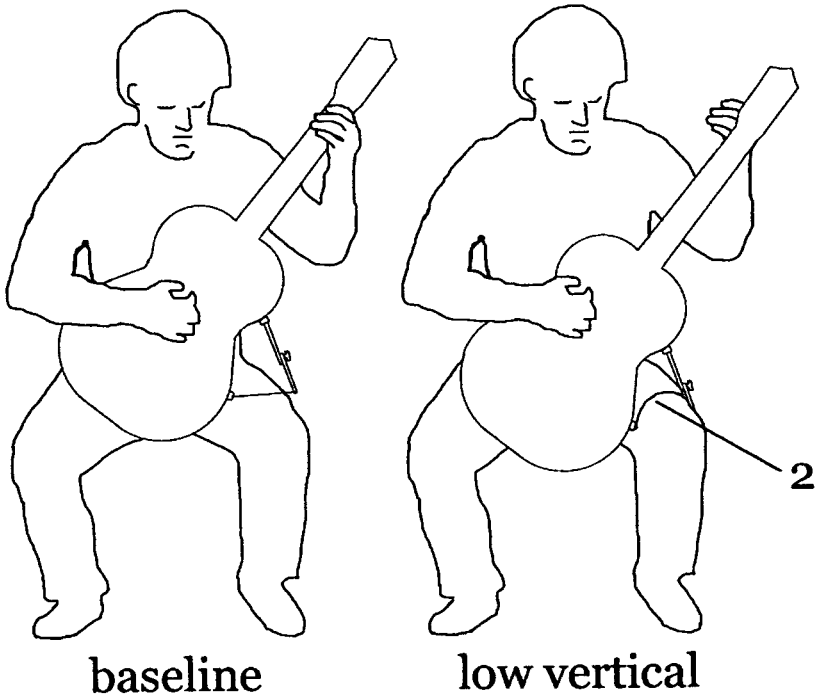
FIG. 5 of the drawings illustrates use of the vertical adjustment mechanism of the support.

FIG. 5 of the drawings illustrates use of the vertical adjustment mechanism of the support. Adjusting the length of the leg support means (2) will alter the vertical position of the instrument vis-à-vis the user.

Figure 6:
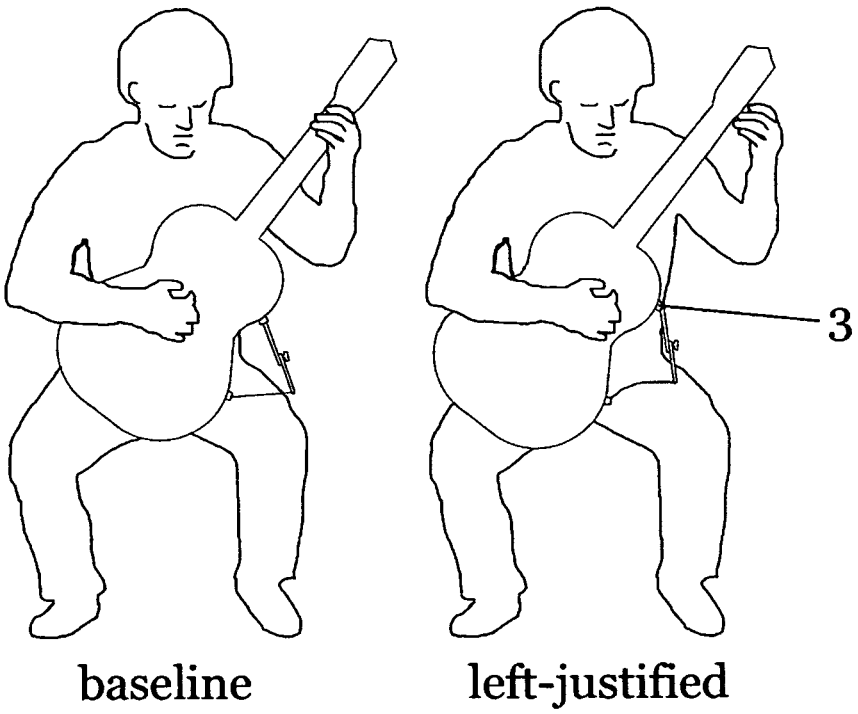
FIG. 6 of the drawings illustrates use of the horizontal adjustment mechanism of the support.

FIG. 6 of the drawings illustrates use of the horizontal adjustment mechanism of the support. Adjusting the longitudinal position of the support on the underside of the guitar will alter the horizontal position of the instrument vis-à-vis the user. The pivoting attachment means (3) allow for this adjustment.

Figure 7:
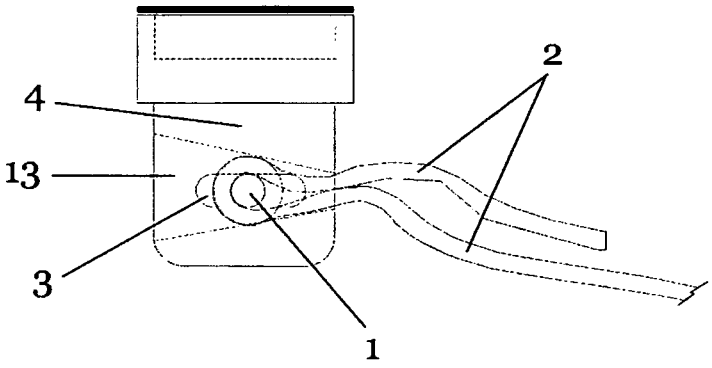
FIG. 7 of the drawings is a perspective detailed view of the first magnet housing and leg support means adjustment mechanism.

FIG. 7 of the drawings illustrates a detailed semi-transparent view of the first magnet housing (4). The leg support means (2) is secured in the machined void (13) when the securing pin or similar member (1) is forced along the length of the channel (3) toward the majority portion of the support and is fixed between the magnet housing (4) and the securing member (1).

Figure 8:
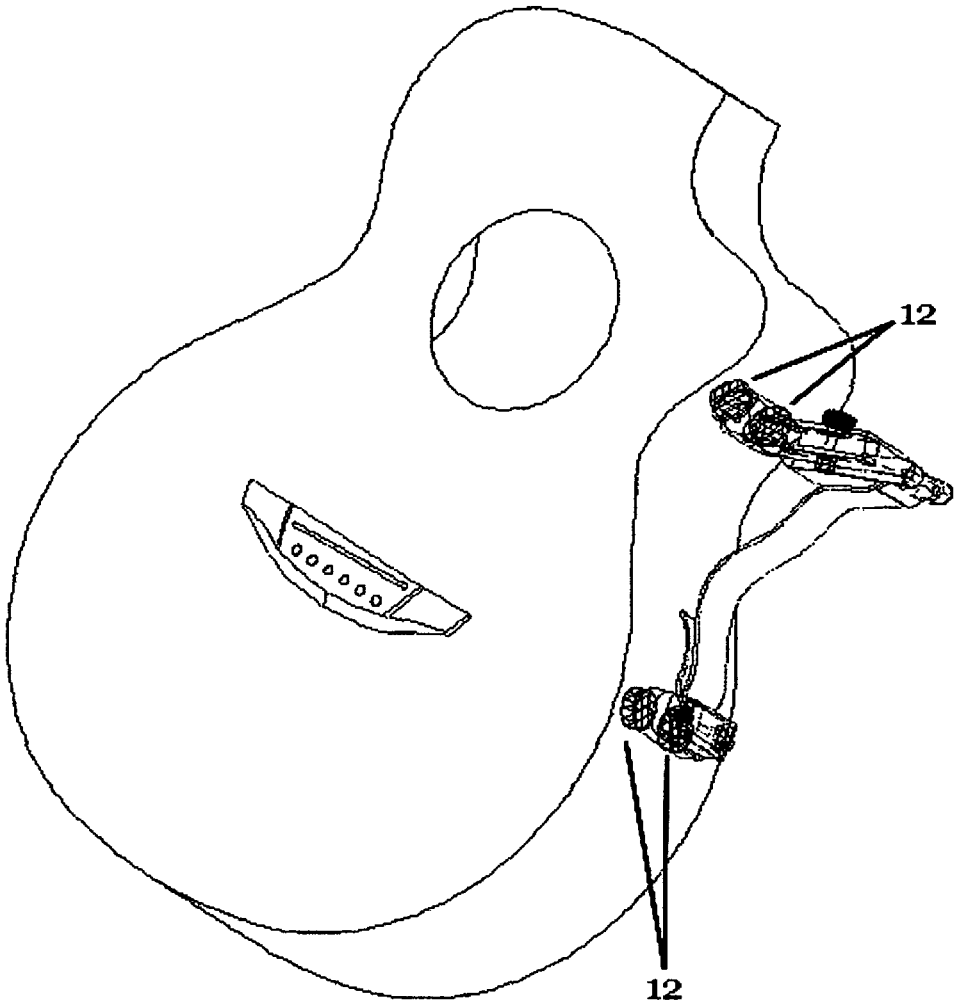
FIG. 8 of the drawings is a perspective view of the instrument support attached to a stringed instrument.

FIG. 8 of the drawings is a semi-transparent perspective view of the instrument support attached to an instrument. The internal magnet(s) or magnetic material (12) affixed on or in the instrument is visible.

Figure 9:
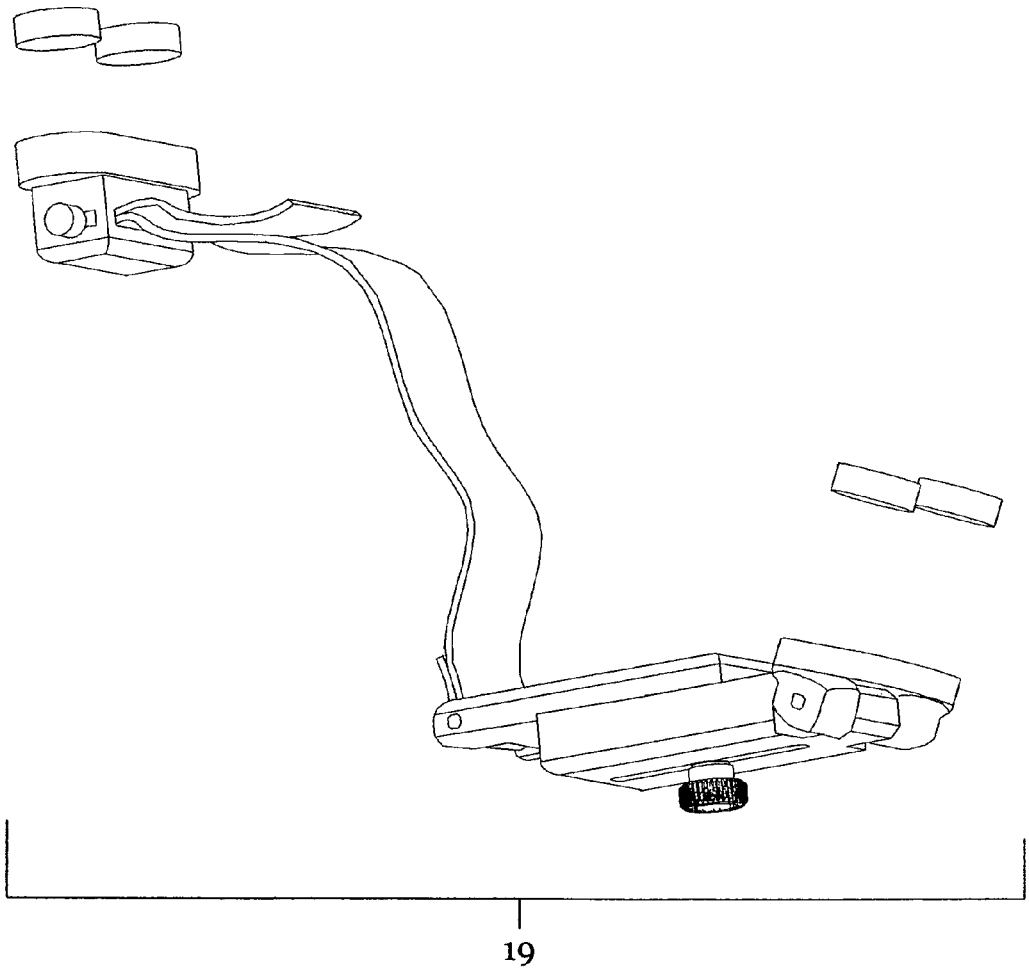
FIG. 9 of the drawings is a 3 dimensional view of the instrument support.

FIG. 9 of the drawings is a 3-dimensional view of the guitar support (19). The internal magnet(s) or magnetic material is not visible.

That which is claimed is:

1. A stringed instrument support comprising;

a) an elongated, flexible, and slip-resistant leg support means having a first and second performing end;

b) a first magnet housing affixed at said first performing end;

i) magnet(s) or magnetic material affixed to said first magnet housing attract other magnet(s) or magnetic material affixed on or in said stringed instrument and is the sole attachment mechanism of said first magnet housing to said instrument;

ii) said first magnet housing comprising an adjustment mechanism allowing the length of said flexible leg support means to be adjusted and secured within said first magnet housing;

iii) said flexible leg support means enters said first magnet housing through a first side, envelopes a securing member, and exits said first magnet housing through said first side;

iv) said securing member travels along the length of a channel through physical force securing said leg support means against said first magnet housing and said securing member;

v) said first magnet housing comprising a soft, slip-resistant, and non-corrosive material as an interface between said stringed instrument and said first magnet housing;

c) a first rigid support means affixed at said second performing end;

i) said first rigid support means comprising a means to affix said leg support means to itself;

ii) said first rigid support means comprising a threaded female member;

iii) a second rigid support means comprising a channel along its length;

iv) said channel allows a threaded male member to pass through and be secured into said threaded female member;

d) a second magnet housing comprising a hinge or like mechanism connects to said second rigid support member allowing rotation around its axis;

i) said second magnet housing comprising magnet(s) or magnetic material attract other magnet(s) or magnetic material affixed on or in said stringed instrument and is the sole attachment mechanism of said second magnet housing to said instrument;

ii) said second magnet housing comprising a soft, slip-resistant, and non-corrosive material as an interface between said stringed instrument and said second magnet housing.

2. Said support according to claim 1 wherein said support attachment means to the instrument is magnetic attraction.

3. Said support according to claim 1 wherein said support has 3 discrete adjustability mechanisms;

a) adjusting the overall length of said leg support means will alter the vertical position of said instrument vis-à-vis the user while attached to said instrument support;

b) adjusting the overall length of said first and said second rigid support means will alter the angle of said instrument in relation to an assumed horizontal plane while attached to said instrument support;

c) adjusting the longitudinal position of said first and said second magnet housing along the underside of said instrument will alter the horizontal positioning of said instrument vis-à-vis said user while attached to said instrument support.

* * * * *